US007919061B2

(12) United States Patent
Ding

(10) Patent No.: US 7,919,061 B2
(45) Date of Patent: Apr. 5, 2011

(54) PIPETTE DEVICE SYSTEM AND MICROPIPETTE THEREOF

(75) Inventor: Shih-Hung Ding, Sanchong (TW)

(73) Assignee: OME Technology Co., Ltd., Sansai Township (TW)

( * ) Notice: Subject to any disclaimer, the term of this patent is extended or adjusted under 35 U.S.C. 154(b) by 344 days.

(21) Appl. No.: 12/261,547

(22) Filed: Oct. 30, 2008

(65) Prior Publication Data

US 2010/0111769 A1 May 6, 2010

(51) Int. Cl.
*B01L 3/00* (2006.01)

(52) U.S. Cl. ..... 422/501

(58) Field of Classification Search ..... 422/100, 422/501

See application file for complete search history.

(56) References Cited

U.S. PATENT DOCUMENTS 3,188,181 A * 6/1965 Peterson et al. ..... 141/130
3,189,413 A * 6/1965 Davis ..... 422/70
6,241,947 B1 * 6/2001 Komatsu et al. ..... 422/67

* cited by examiner

*Primary Examiner* — Walter D Griffin
*Assistant Examiner* — Bobby Ramdhanie
(74) *Attorney, Agent, or Firm* — C. G. Mersereau; Nikolai & Mersereau, P.A.

(57) ABSTRACT

A pipette device system and micropipette thereof is disclosed. The micropipette is disposed on the pipette device system and includes a pipe body, a rotating shaft and a swing member. A rotating hole and an engaging hole of the pipe body are connected with each other. A receiving hole and a discharging hole are formed in the pipe body and connected with the rotating hole. The rotating shaft is disposed in the rotating hole and has a connecting hole and a switching hole. A first connecting opening and a second connecting opening of the connecting hole are respectively connected with the receiving hole and the discharging hole. The switching hole has a third connecting opening and is connected with the connecting hole. The swing member is fixed on two ends of the rotating shaft. The present invention can implement the multiple micro-dispensation based on the simple structure and movement manner.

13 Claims, 7 Drawing Sheets

PIPETTE DEVICE SYSTEM AND MICROPIPETTE THEREOF

BACKGROUND OF THE INVENTION

1. Field of the Invention

The present invention relates to a pipette device system and micropipette thereof, and more particularly to a pipette device system and micropipette thereof which can suck and discharge quantitative liquid.

2. Description of Related Art

Micropipettes are widely used in chemical laboratories, biological Laboratories, medical Laboratories and so on and occupy a decisive position not only on teaching experiments but also on practical medical engineering technology.

Micropipettes can suck liquid in one vessel and transfer it into another vessel for liquid mixture or measurement operations. Depending on the micropipettes, related technicians can accurately control a liquid suction amount and a liquid discharge amount, thereby meeting the requirement of accurate experimental results.

Conventional micropipettes generally include manual micropipettes and electronic micropipettes. Manual micropipettes require manual dispensation and thus entail a large amount of repetitive movements, which consumes working time and reduces work efficiency.

Since manual micropipettes are inconvenient for use, electronic micropipettes emerge as times require. However, electronic micropipettes have complex structures, high manufacture costs and are difficult to maintain.

Additionally, most micropipettes perform dispensation via a single or a plurality of dispensation ports, that is, liquid is sucked and discharged via the same port, so technicians must insert the dispensation port into a predetermined vessel to suck the liquid firstly, and then move the micropipette above another vessel to discharge the liquid. There are a lot of dispensation movements, so it needs a complex structure and large space to perform the dispensation movements described above when the micropipette is applied on automatic equipment.

Hence, the inventors of the present invention believe that the shortcomings described above are able to be improved and finally suggest the present invention which is of a reasonable design and is an effective improvement based on deep research and thought.

SUMMARY OF THE INVENTION

A main object of the present invention is to provide a pipette device system and micropipette thereof which can implement multiple micro-dispensation in a simple movement manner and has the advantages of simple structure, saving space, easy maintenance and low costs.

To achieve the above-mentioned object, a micropipette in accordance with the present invention is provided. The micropipette includes: a pipe body having a rotating hole, an engaging hole, a receiving hole and a discharging hole, wherein the rotating hole and the engaging hole are formed in a peripheral surface of the pipe body in radial direction of the pipe body, the rotating hole and the engaging hole are connected with each other in the pipe body, the receiving hole is formed in the pipe body and connected with the rotating hole, and the discharging hole is connected with the rotating hole and axially formed in one end of the pipe body; a rotating shaft pivotingly disposed in the rotating hole and having a connecting hole and a switching hole, wherein the connecting hole extends through the rotating shaft in radial direction of the rotating shaft and has a first connecting opening and a second connecting opening which are respectively formed in two ends of the connecting hole and connected with the receiving hole and the discharging hole, and the switching hole has a third connecting opening formed in a circumferential surface of the rotating shaft and the switching hole is formed in the radial direction of the rotating shaft and connected with the connecting hole; and a swing member which is fixed at two ends of the rotating shaft.

To achieve the above-mentioned object, a pipette device system in accordance with the present invention is further provided. The pipette device system includes: a base having at least one upright column and a fixed arm fixed on the upright column; an actuation device group including a driving assembly, a floating joint and a floating board, wherein the driving assembly is disposed on the base, the floating board is slidably disposed on the upright column, and the floating joint connects the driving assembly with the floating board; a micropipette including a pipe body, a rotating shaft and a swing member, wherein the pipe body has a rotating hole, an engaging hole, a receiving hole and a discharging hole, wherein the rotating hole and the engaging hole are formed in a peripheral surface of the pipe body in radial direction of the pipe body, the rotating hole and the engaging hole are connected with each other in the pipe body, the receiving hole is formed in the pipe body and connected with the rotating hole, and the discharging hole is connected with the rotating hole and axially formed in one end of the pipe body; the rotating shaft is pivotingly disposed in the rotating hole and has a connecting hole and a switching hole, wherein the connecting hole extends through the rotating shaft in radial direction of the rotating shaft and has a first connecting opening and a second connecting opening which are respectively formed in two ends of the connecting hole and connected with the receiving hole and the discharging hole, and the switching hole has a third connecting opening formed in a circumferential surface of the rotating shaft and the switching hole is formed in the radial direction of the rotating shaft and connected with the connecting hole; and the swing member is fixed at two ends of the rotating shaft and connected with the floating board; and a placement platform which is correspondingly disposed below the micropipette.

The efficacy of the present invention is as follows:

When the rotating shaft rotates, the first, the second and the third connecting openings follow the rotating shaft to rotate, wherein the first connecting opening leaves the receiving hole to be connected with the engaging hole and the third connecting opening is synchronously switched to the receiving hole and connected with the receiving hole. At this time, quantitative liquid can be led to flowing into the receiving hole itself. When the rotating shaft rotates to the initial position so that the connecting hole can be connected with the receiving hole once again, the liquid can be discharged along the discharging hole. Accordingly, the present invention can implement the multiple micro-dispensation based on the simple structure and movement manner. The present invention has the advantages of simple structure, saving space, easy maintenance and low costs.

To further understand features and technical contents of the present invention, please refer to the following detailed description and drawings related the present invention. However, the drawings are only to be used as references and explanations, not to limit the present invention.

DETAILED DESCRIPTION OF PREFERRED EMBODIMENTS

Figure 1:
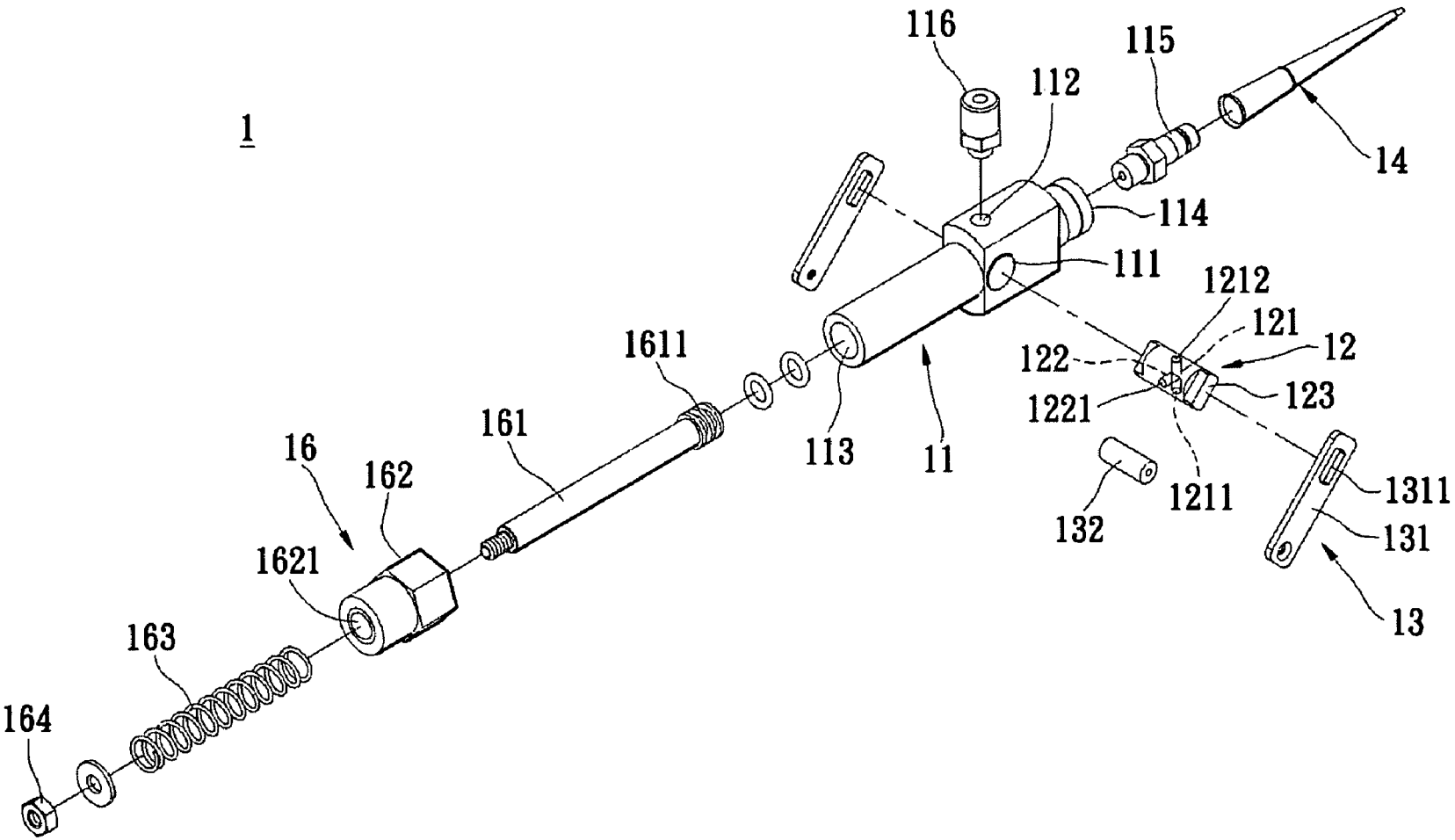
FIG. 1 is an exploded perspective view of a micropipette of the present invention.

Please refer to FIGS. 1-8 illustrating a pipette device system and micropipette thereof according to the present invention. The micropipette 1 includes a pipe body 11, a rotating shaft 12, a swing member 13, a dispensing pipe 14, a flexible pipe 15 and a volume adjustment assembly 16.

Figure 2:
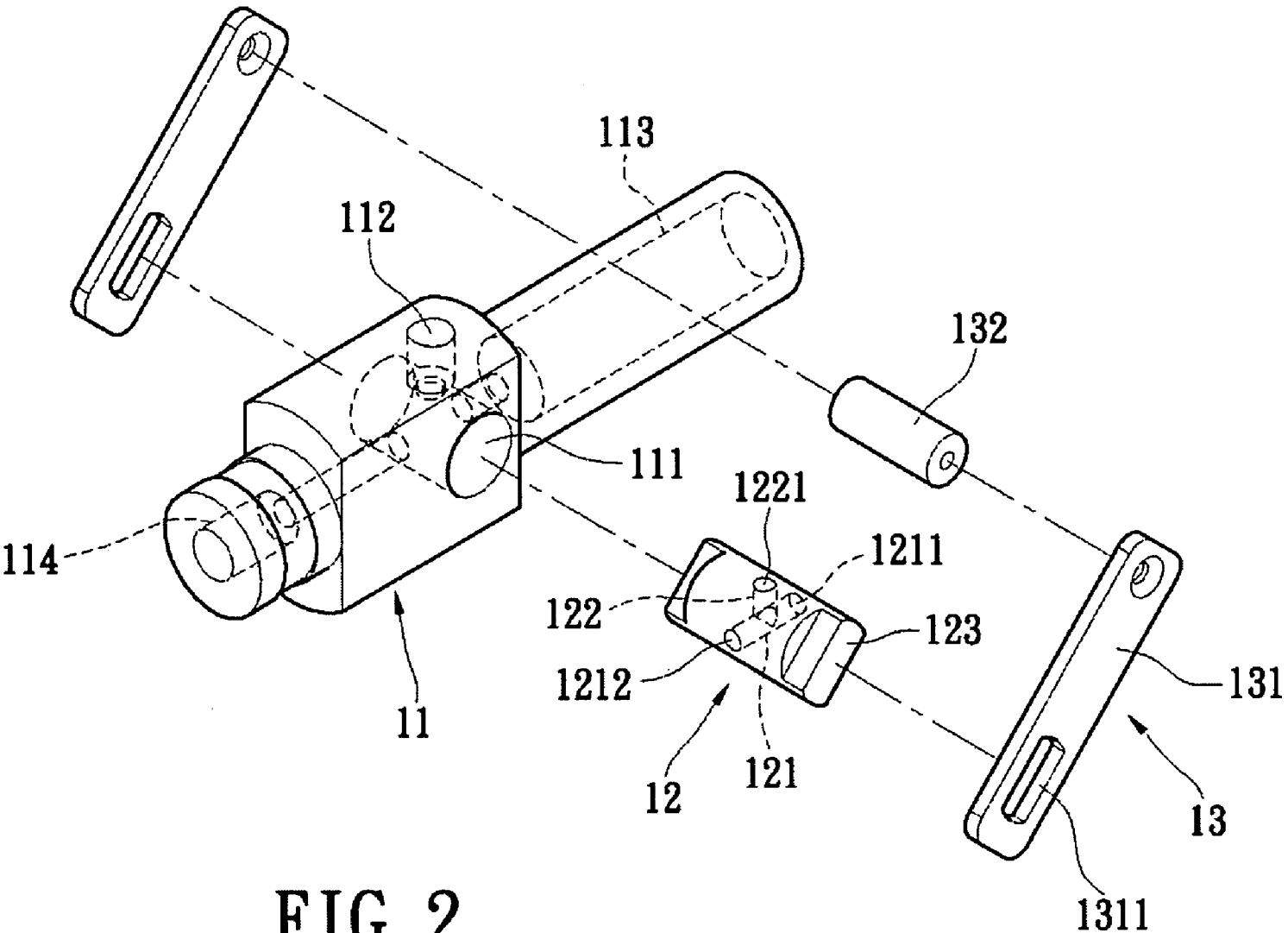
FIG. 2 is an enlarge view of a rotating hole and a rotating shaft of the micropipette of the present invention.
Figure 3:
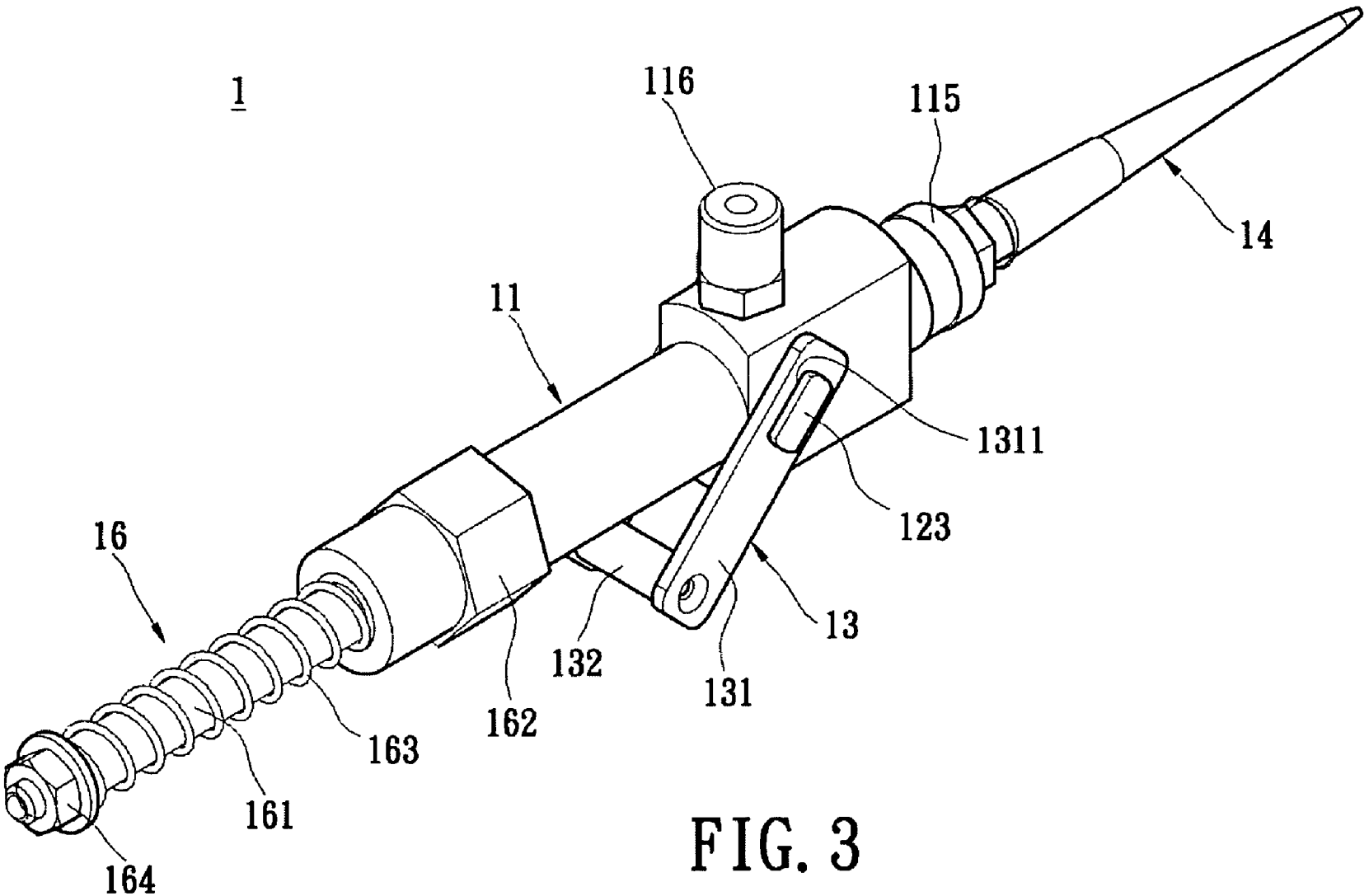
FIG. 3 is an assembled perspective view of the micropipette of the present invention.

Please refer to FIGS. 1-3, the pipe body 11 has a rotating hole 111, an engaging hole 112, a receiving hole 113 and a discharging hole 114.

The rotating hole 111 and the engaging hole 112 are formed in the peripheral surface of the pipe body 11 in radial direction of the pipe body 11. The rotating hole 111 is a circular through-hole extending through the pipe body 11, which is orthogonally connected with the engaging hole 112 in the pipe body 11.

The discharging hole 114 is connected with the rotating hole 111 and axially formed in one end of the pipe body 11. The receiving hole 113 is formed in the pipe body 11, extends through the other end of the pipe body 11, and is connected with the rotating hole 111 in axial direction of pipe body 11.

The pipe body 11 has a discharging joint 115 and a suction joint 116 disposed thereon, wherein the discharging joint 115 engages with the discharging hole 114 and the suction joint 116 engages with the engaging hole 112.

Figure 4:
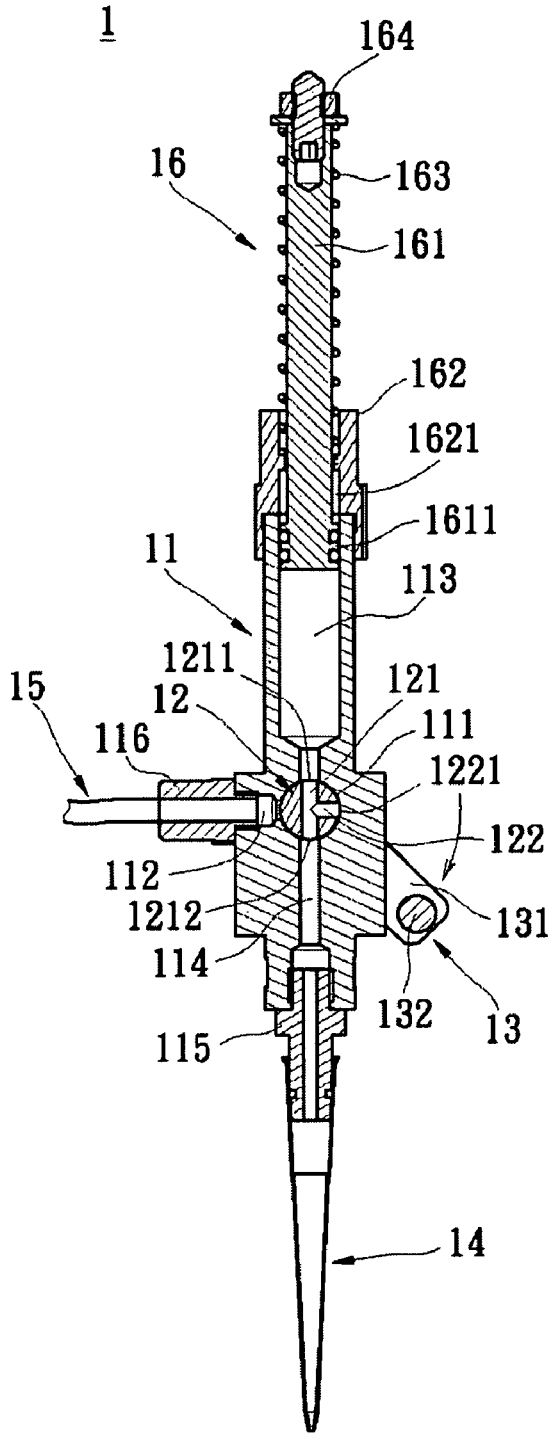
FIG. 4 is a schematic view (1) showing the movement of the micropipette of the present invention.

The rotating shaft 12 is pivotingly disposed in the rotating hole 111. The rotating shaft 12 has a connecting hole 121, a switching hole 122 and two ridge portions 123. The connecting hole 121 extends through the rotating shaft 12 in the radial direction of the rotating shaft 12. The connecting hole 121 has a first connecting opening 1211 and a second connecting opening 1212 which are respectively formed in two ends of the connecting hole 121 and connected with the receiving hole 113 and the discharging hole 114 (as shown in FIG. 4). The switching hole 122 has a third connecting opening 1221 in the circumferential surface of the rotating shaft 12. The switching hole 122 is formed in the radial direction of the rotating shaft 12 and orthogonally connected with the connecting hole 121. Accordingly, the connecting hole 121 and the switching hole 122 form a T-shaped cavity in the rotating shaft 12 for suction and discharge of liquids.

The two ridge portions 123 are non-circular blocks respectively formed on two ends of the rotating shaft 12 and respectively extend out of two ends of the rotating hole 111 to correspond to the below mentioned swing element 13.

The swing element 13 includes two swing arms 131 and a connecting rod 132 connecting the two swing arms 131. The two swing arms 131 each have a fixing hole 1311 and the two fixing holes 1311 are non-circular holes corresponding to the ridge portions 123. The ridge portions 123 of the two ends of the rotating shaft 12 are respectively disposed in the fixing holes 1311 of the two swing arms 131. Based on the engagement of the non-circular ridge portions 123 and the non-circular fixed holes 1311, the swing element 13 can synchronously drive the rotating shaft 12 to rotate when swinging.

Figure 6:
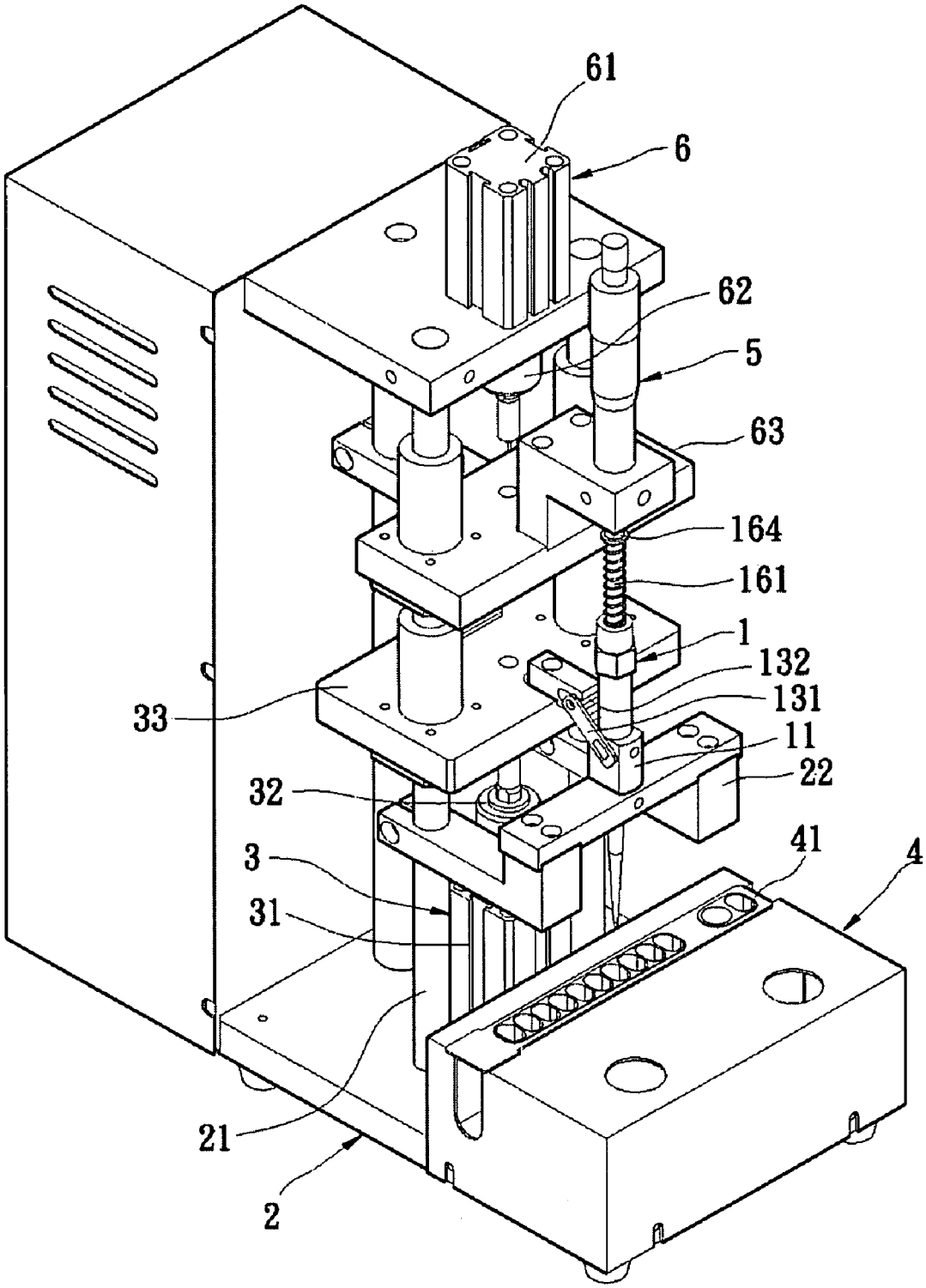
FIG. 6 is an assembled perspective view of a pipette device system of the present invention.

The dispensing pipe 14 is tapered and has two open ends, of which one end with a larger pipe diameter engages with the discharging joint 115. The flexible pipe 15 is a long pipe with flexibility, of which one end engages with the suction joint 116 (as shown in FIG. 6). Thereby, a complete liquid flowing path is formed.

Please refer to FIG. 1, the volume adjustment assembly 16 includes a piston rod 161, a securing nut 162, a compression spring 163 and an adjustment nut 164.

The securing nut 162 has a through-hole 1621 and engages with the other end of the pipe body 11. The piston rod 161 passes through the through-hole 1621, and the piston rod 161 has a piston 1611 on one end thereof, which is disposed in the receiving hole 113. The piston 1611 forms a close-fit with the inner wall of the receiving hole 113 and may move in a straight reciprocating manner.

The adjustment nut 164 engages with the other end of the piston rod 161. The compression spring 163 surrounds the piston rod 161, the two ends of the compression spring 163 abutting on the adjustment nut 164 and the securing nut 162, respectively. When it is desired to adjust the volume of the receiving hole 113, the adjustment nut 164 may be tightened or loosed so that the piston 1611 may move forward or backward in the receiving hole 113 to be positioned in an expected position, under the force of the compression spring 163. Accordingly, the volume of the receiving hole 113 can be adjusted so as to control the suction and the discharge of the expected quantitative liquid.

Please refer to FIG. 4 illustrating initial positions of the first connecting opening 1211, the second connecting opening 1212 and the third connecting opening 1221. At this time, there is no liquid stored in the receiving hole 113.

Figure 5:
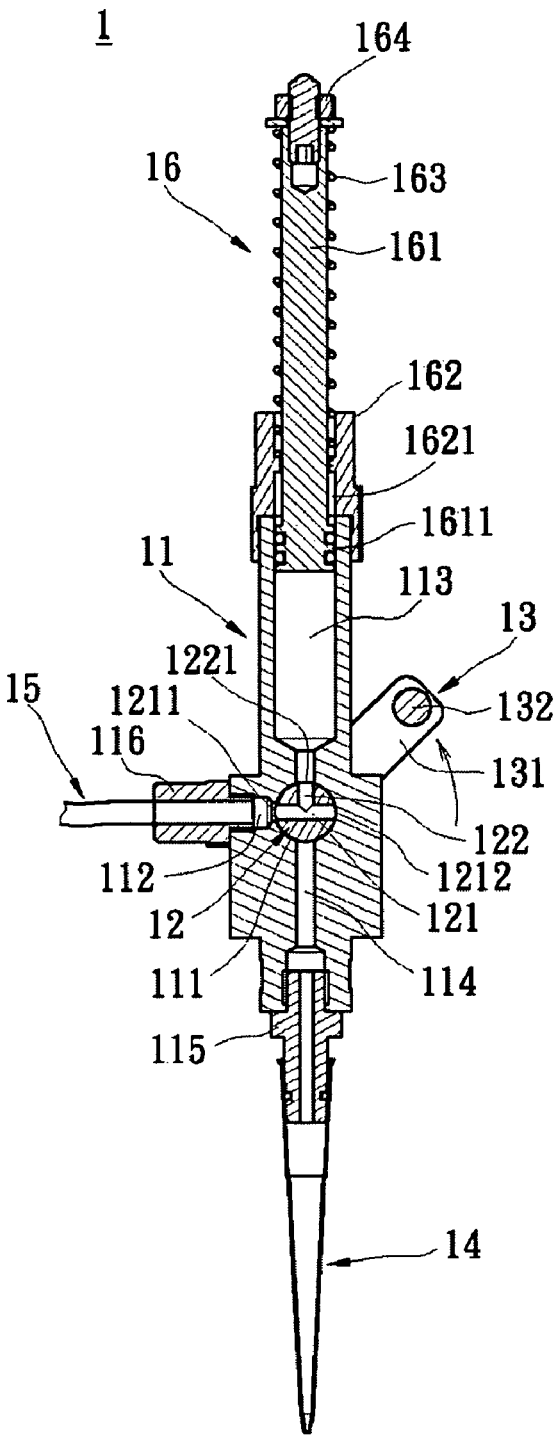
FIG. 5 is a schematic view (2) showing the movement of the micropipette of the present invention.

Please refer to FIG. 5, when it is desired to dispense liquid into the receiving hole 113, the swing member 13 firstly swings 90 degrees, so that the first connecting opening 1211 is switched to the engaging hole 112 and connected with the suction joint 116 and the flexible pipe 15. At this time, the liquid can be led to flowing into the receiving hole 113 itself.

After the receiving hole 113 is filled with the liquid, the swing member 13 may be controlled to swing to the initial position, so that the first connecting opening 1211 and the second connecting opening 1212 of the connecting hole 121 are respectively connected with the receiving hole 113 and the discharging hole 114 once again (as shown in FIG. 4). Accordingly, the liquid can flow along the connecting hole 121 and the discharging hole 114 in the receiving hole 113 to the dispensing pipe 14 to be discharged.

Figure 7:
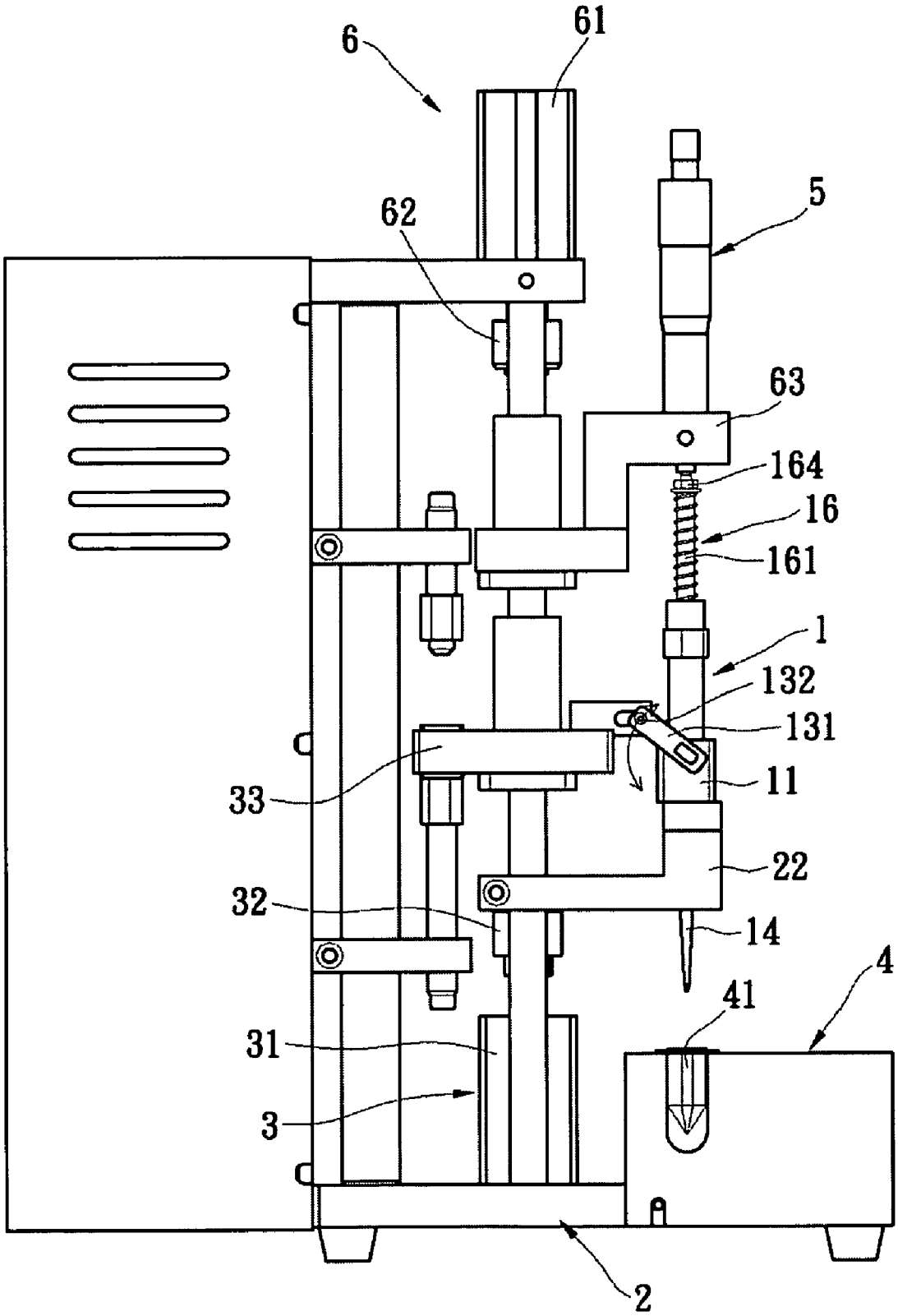
FIG. 7 is a schematic view showing that the actuation-device group of the present invention drives the micropipette to suck liquid.
Figure 8:
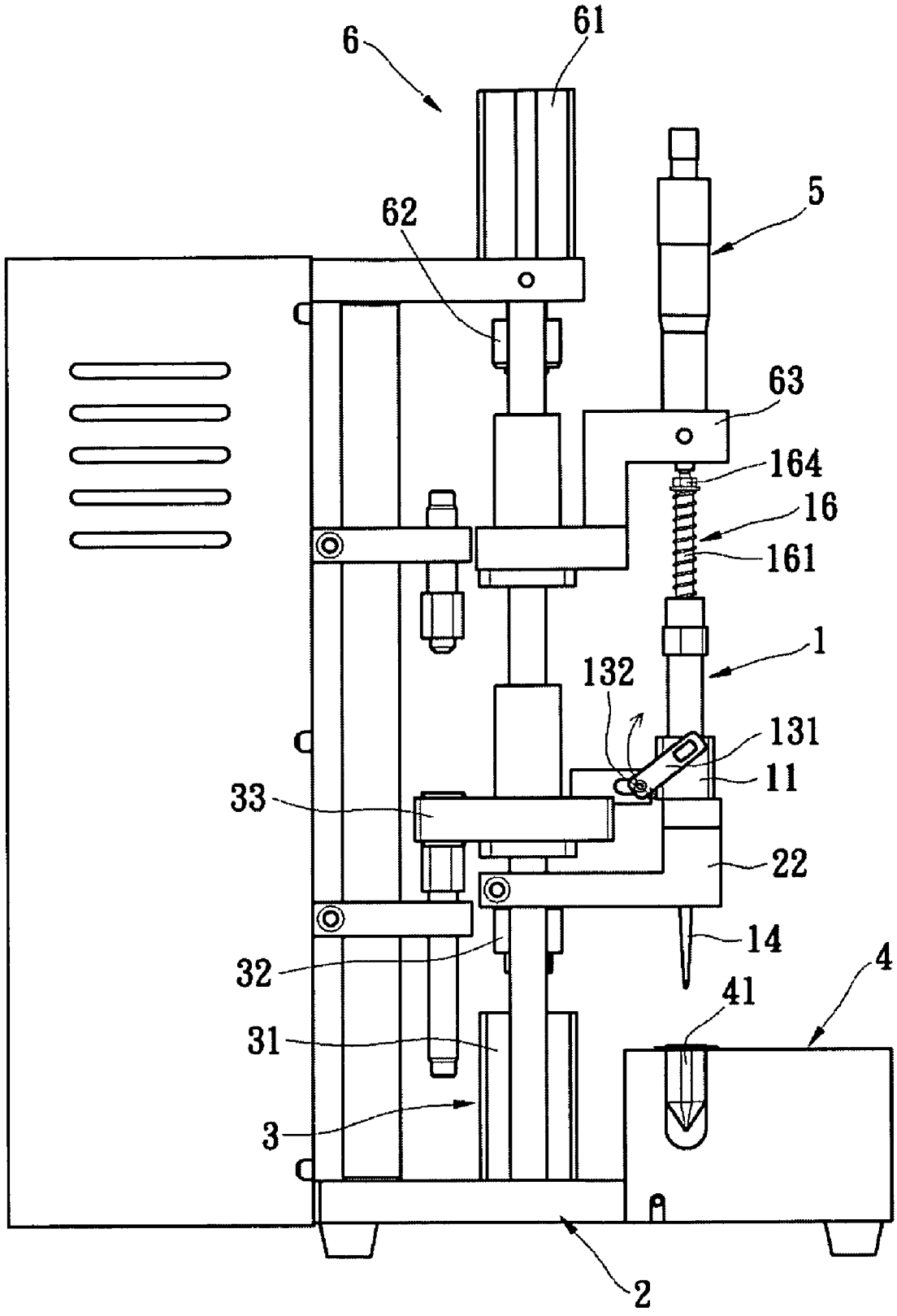
FIG. 8 is a schematic view showing that the actuation device group of the present invention drives the micropipette to discharge liquid.

Please refer to FIGS. 6-8, the pipette device system includes a micropipette 1, a base 2, an actuation device group 3, a placement platform 4 and a micrometer 5.

The base 2 has two upright columns 21 and a fixed arm 22 fixed on the two upright columns 21.

The actuation device group 3 includes a driving assembly 31, a floating joint 32 and a floating board 33. The driving assembly 31 is a cylinder, which is disposed on the base 2. The floating board 33 is disposed above the driving assembly 31 and slidably disposed on the two upright columns 21. The floating joint 32 connects the driving assembly 31 with the floating board 33.

The pipe body 11 of the micropipette 1 is fixed on the fixed arm 22 and the connecting rod 132 of the swing member 13 is connected with the floating board 33.

The placement platform 4 is correspondingly disposed below the micropipette 1. At least one liquid vessel 41 is disposed on the placement platform 4 for collecting the liquid discharged from the micropipette 1.

Based on the above structure, when being supplied with energy, the driving assembly 31 may drive the floating joint 32 to move in a straight reciprocating manner and the floating board 33 to slide up and down. Meanwhile, the connecting rod 132 connected with the floating board 33 and the swing arms 131 swing synchronously to rotate the rotating shaft 12 (please refer to FIG. 4 and FIG. 5), thereby automatically reciprocatingly performing the liquid suction and discharge described above.

Please refer to FIG. 7 and FIG. 8, the pipette device system of the present invention further has a micrometer 5 and another actuation device group 6 which are disposed above the micropipette 1. The micrometer 5 is fixed on a floating board 63 of the actuation device group 6 and abuts on the adjustment nut 164 of the micropipette 1. The driving assembly 61 also is a cylinder. When the driving assembly 61 drives the floating joint 62, the floating board 63 can make the micrometer 5 move automatically and abut on the adjustment nut 164 of the volume adjustment assembly 16. Accordingly, the micrometer 5 can measure the displacement of the piston rod 161 so that the volume of the receiving hole 113 in the pipe body 11 can be figured out.

Consequently, the present invention has the efficacy and the characteristics as follows:

When the rotating shaft 12 rotates, the first, the second and the third connecting openings 1211, 1212, 1221 follow the rotating shaft 12 to rotate, wherein the first connecting opening 1211 leaves the receiving hole 113 to be connected with the engaging hole 112 and the third connecting opening 1212 is synchronously switched to the receiving hole 113 and connected with the receiving hole 113. At this time, quantitative liquid can be led to flowing into the receiving hole 113 itself. When the rotating shaft 12 rotates to the initial position so that the connecting hole 121 can be connected with the receiving hole 113 once again, the liquid can be discharged along the discharging hole 114. Accordingly, the present invention can implement the multiple micro-dispensation based on the simple structure and movement manner. The present invention has the advantages of simple structure, saving space, easy maintenance and low costs.

What are disclosed above are only the specification and the drawings of the preferred embodiment of the present invention and it is therefore not intended that the present invention be limited to the particular embodiment disclosed. It will be understood by those skilled in the art that various equivalent changes may be made depending on the specification and the drawings of the present invention without departing from the scope of the present invention.

What is claimed is:

1. A micropipette, comprising:

a pipe body, having a rotating hole, an engaging hole, a receiving hole and a discharging hole, wherein the rotating hole and the engaging hole are formed in a peripheral surface Of the pipe body in radial direction of the pipe body, the rotating hole and the engaging hole are connected with each other in the pipe body, the receiving hole is formed in the pipe body and connected with the rotating hole, and the discharging hole is connected with the rotating hole and axially formed in one end of the pipe body;

a rotating shaft, pivotingly disposed in the rotating hole and having a connecting hole and a switching hole, wherein the connecting hole extends through the rotating shaft in radial direction of the rotating shaft and has a first connecting opening and a second connecting opening which are respectively formed at two ends of the connecting hole and connected to the receiving hole and the discharging hole and the switching hole has a third connecting opening formed on a circumferential surface of the rotating shaft and the switching hole is formed in the radial direction of the rotating shaft and connected with the connecting hole; and a swing member, fixed on two ends of the rotating shaft.

2. The micropipette as claimed in claim 1, wherein the rotating shaft has two ridge portions respectively formed its two ends, the swing member has two swing arms and a connecting rod connecting the two swing arms, each swing arm having a fixing hole, and the ridge portions formed on the two ends of the rotating shaft are respectively disposed in the fixing holes of the two swing arms.

3. The micropipette as claimed in claim 2, wherein the pipe body has a volume adjustment assembly which includes a securing nut, a piston rod, a compression spring and an adjustment nut, wherein the securing nut has a through-hole, the receiving hole extends through the pipe body and the securing nut engages with one end of the pipe body, the piston rod passes through the through-hole and has a piston on one end thereof, the piston being disposed in the receiving hole, the adjustment nut engages with the other end of the piston rod, and the compression spring surrounds the piston rod, with two ends of the compression spring respectively abutting on the adjustment nut and the securing nut.

4. The micropipette as claimed in claim 2, wherein the pipe body has a discharging joint and a suction joint, the discharging joint engages with the discharging hole, and the suction joint engages with the engaging hole.

5. The micropipette as claimed in claim 4, further comprising a flexible pipe and a dispensing pipe, wherein the flexible pipe engages with the suction joint and the dispensing pipe engages with the discharging joint.

6. A pipette device system, comprising:

a base, having at least one upright column and a fixed arm fixed on the upright column;

an actuation device group, including a driving assembly, a floating joint and a floating board, wherein the driving assembly is disposed on the base, the floating board is slidably disposed on the upright column, and the floating joint connects the driving assembly with the floating board;

a micropipette, including a pipe body, a rotating shaft and a swing member, wherein the pipe body has a rotating hole, an engaging hole, a receiving hole and a discharging hole, wherein the rotating hole and the engaging hole are formed in a peripheral surface of the pipe body in radial direction of the pipe body, the rotating hole and the engaging hole are connected with each other in the pipe body, the receiving hole is formed in the pipe body and connected with the rotating hole, and the discharging hole is connected with the rotating hole and axially formed in one end of the pipe body; the rotating shaft is pivotingly disposed in the rotating hole and has a connecting hole and a switching hole, wherein the connecting hole extends through the rotating shaft in radial direction of the rotating shaft and has a first connecting opening and a second connecting opening which are respectively formed in two ends of the connecting hole and connected with the receiving hole and the discharging hole, and the switching hole has a third connecting opening formed on a circumferential surface of the rotating shaft and the switching hole is formed in radial direction of the rotating shaft and connected with the connecting hole; and the swing member is fixed on two ends of the rotating shaft and connected with the floating board; and a placement platform, correspondingly disposed below the micropipette.

7. The pipette device system as claimed in claim 6, wherein the rotating shaft has two ridge portions respectively formed on its two ends; the swing member has two swing arms and a connecting rod connecting the two swing arms, each swing arm having a fixing hole; and the ridge portions formed on the two ends of the rotating shaft are respectively disposed in the fixing holes of the two swing arms.

8. The pipette device system as claimed in claim 7, wherein the pipe body has a volume adjustment assembly which includes a securing nut, a piston rod, a compression spring and an adjustment nut, wherein the securing nut has a through-hole, the receiving hole extends through the pipe body and the securing nut engages with one end of the pipe body; the piston rod passes through the through-hole and has a piston on one end thereof, which is disposed in the receiving hole; the adjustment nut engages with the other end of the piston rod; and the compression spring surrounds the piston rod, with two ends of the compression spring respectively abutting on the adjustment nut and the securing nut.

9. The pipette device system as claimed in claim 8, further comprising a micrometer and another actuation device group disposed above the micropipette, wherein the micrometer is fixed on a floating board of the actuation device group and abuts on the adjustment nut of the micropipette.

10. The pipette device system as claimed in claim 8, wherein the pipe body has a discharging joint and a suction joint, and the discharging joint engages with the discharging hole and the suction joint engages with the engaging hole.

11. The pipette device system as claimed in claim 10, further comprising a flexible pipe and a dispensing pipe, wherein the flexible pipe engages with the suction joint and the dispensing pipe engages with the discharging joint.

12. The pipette device system as claimed in claim 7, wherein at least one liquid vessel is disposed on the placement platform.

13. The pipette device system as claimed in claim 8, wherein the driving assembly is a cylinder.

* * * * *

UNITED STATES PATENT AND TRADEMARK OFFICE

CERTIFICATE OF CORRECTION

PATENT NO. : 7,919,061 B2
APPLICATION NO. : 12/261547
DATED : April 5, 2011
INVENTOR(S) : Shih-Hung Ding It is certified that error appears in the above-identified patent and that said Letters Patent is hereby corrected as shown below:

On the Title Page the Assignee's Address should read:

(73) Assignee: OME Technology Co., Ltd., Sansia Township (TW)

Signed and Sealed this
Twenty-eighth Day of June, 2011

David J. Kappos

David J. Kappos
*Director of the United States Patent and Trademark Office*